United States Patent [19]

Esser

[11] 4,279,949

[45] Jul. 21, 1981

[54] PROCESS AND APPARATUS FOR COATING WEBS AND ADJUSTING THE WET APPLICATION WEIGHT OF THE COATING MATERIAL

[75] Inventor: Reinhard Esser, Bergisch-Gladbach, Fed. Rep. of Germany

[73] Assignee: J. M. Voith GmbH, Fed. Rep. of Germany

[21] Appl. No.: 81,784

[22] Filed: Oct. 4, 1979

[30] Foreign Application Priority Data

Oct. 5, 1978 [DE] Fed. Rep. of Germany ..... 2843371

[51] Int. Cl.[3] ..... B05D 3/12; B05D 1/28; B05C 11/02; B05C 3/02

[52] U.S. Cl. ..... 427/356; 118/126; 118/407; 427/358; 427/428

[58] Field of Search ..... 118/126, 407; 427/356, 427/358, 428

[56] References Cited

U.S. PATENT DOCUMENTS

| | | | |
|---|---|---|---|
| 2,051,403 | 8/1936 | Boyer et al. | 427/172 |
| 2,534,320 | 12/1950 | Taylor . | |
| 3,143,438 | 8/1964 | Campbell | 118/126 X |

FOREIGN PATENT DOCUMENTS 1071039 12/1959 Fed. Rep. of Germany .

*Primary Examiner*—Michael R. Lusignan

*Attorney, Agent, or Firm*—Ostrolenk, Faber, Gerb & Soffen

[57] ABSTRACT

The disclosure concerns both an apparatus and a method for adjusting the applied weight of a coating composition on a web traveling over a support roll. The support roll is opposed by a scraper that removes excess coating composition which was just previously applied to the web. The scraper has an entrance flank that is opposed to the support roll. The downstream end of the entrance flank is defined by a sharp edged end. The length of the pressing zone between the scraper and the support roll is adjusted by swiveling the scraper around its axis with respect to the support roll so as to adjust the position of the sharp edged end of the scraper with respect to the coated surface of the web. The surface of the support roll is elastic so that it can be depressed under the pressure applied thereto by the sharp edged end of the entrance flank. The scraper may be developed as a sector of a roll having the axis of the scraper as the axis of the curve. Further, there may be a plurality of scrapers on a single support body, thereby facilitating easy substitution of scrapers.

26 Claims, 5 Drawing Figures

PROCESS AND APPARATUS FOR COATING WEBS AND ADJUSTING THE WET APPLICATION WEIGHT OF THE COATING MATERIAL

This invention relates to a process and apparatus for coating webs, preferably flexible webs, and particularly webs of paper, cardboard, or the like, with ordinary pigment dispersions. The invention particularly relates to the adjustment of the wet application weight of the coating material.

BACKGROUND OF THE INVENTION

The specification hereafter describes paper webs, but webs of other materials are also contemplated. In order to improve the printability of paper web surfaces and to adapt them to specific printing processes, such paper web surfaces are at present coated with pigment/vehicle dispersions. Depending on the purpose of use, the dry application weights of the coating materials are between 5 and 35 g./m.$^2$. The coatings are customarily effected using an aqueous dispersion with different contents of solids so that the wet application weights of the coatings are considerably higher than their dry weights.

It has been found advisable to first apply excess coating material to the traveling web of material and to then remove the excess from the surface by dosaging devices. Simultaneous smoothing of the surface of the coating is desired. Known dosaging devices include roller coating mechanisms in combination with dosaging rollers, so-called reserve roll coaters, roll-scraper dosaging devices, which are also known as doctors, and smooth-scraper devices, better known as "blades".

During the dosaging process, the coated web of material is supported by a supporting device, for instance a roller. Pressure is exerted on the web by the dosaging device, for instance a blade or doctor. The pressure acts against the coating composition.

West German Provisional Patent (Auslegeschrift) No. 10 71 039 describes an apparatus for regulating the applied weight of coating material. The web is supported on the uncoated side thereof by a supporting roller, known as a coating drum, while a doctor knife arranged over the coated side of the roller is provided to adjust the applied weight. The doctor knife is arranged on a rotatably supported shaft and can be pressed with variable application pressure against the traveling web.

West German Pat. No. 486,149 describes an apparatus having a stripping knife as the dosaging device, in which the active edge of the knife is rounded.

U.S. Pat. No. 2,051,403 discloses a coating device which is a development of a stripper. A specially shaped stripper is provided having a curvature with two different radii. The end of the inlet flank of the stripper does not have a sharp edge, since such an edge would lead to a defective surface and unsatisfactory results.

Depending on the amount of the pressure exerted by the dosaging device and depending upon the position of that device with respect to the coated web, a thicker or thinner layer of coating material remains on the web. This is also true of known roll-coating and dosaging systems. In this case, the thickness of application of coating material is dependent upon the diameter of the rolls, the hardness of the surface of the rolls and the circumferential speed of the rolls.

Scrapers of the blade edge and doctor bar type are, considered in themselves, not sufficiently stable tools and require mounts and guides impart to them the required linearity, resistance to bending and resistance to the opposing pressure of the coating composition that is moving along with the traveling web. Particularly high demands are made on the development of such mounts. With web widths of several meters and web speeds of up to 1200 m./min., which are customary today, the requirements can be satisfied only to a certain extent by corresponding structural developments. As a result, known dosaging devices are not satisfactory, particularly in the situation where higher coating material application weights are sought and only low pressures may be opposed to the stream of coating material. Even slight deviations in the linearity of the dosaging device along the direction transverse to the web, caused by manufacturing tolerances or other circumstances, lead to considerable variations in the amounts of coating material that are applied to the web after the dosaging, as measured transversely across the web. It has been attempted to improve the scraper linearity by, for instance, supporting the edge of the blade by means of pressure hoses. The results are unsatisfactory, particularly in the case of larger web widths.

In the roll devices, the rolls used can be adjusted with the required accuracy, even in the case of large width rolls, but the surface quality thereby obtained frequency does not satisfy the requirements, since later contact with the surface of the coated material by the roll, after passage of the web through the zone with the highest pressure, is unavoidable. This later contact splits the coating with a resultant greater or lesser reduction of the smoothness of the surface. Depending on the doctor diameter, this effect is also present in the doctor type dosaging devices. Contrary to this, blades have a sharp edge which limits the length of the coating zone, and this avoids subsequent contact by the dosaging device on the coating material.

Depending upon the applied weight of the coating material, the speed of the web and the flow properties of the coating material, one or the other of the known dosaging devices has been found to be more suitable for a particular application. In practice, roller dosagings have proven better with higher weights of coating material, while with lower weights of coating material and high speeds of web, smoothing-scraper devices are preferred. When a particular dosaging system for a coating plant is selected, a decision is thus indirectly also made as to the spectrum of products which can be optimally produced. With the increasing sizes of manufacturing plants and their higher investment costs, upon the installation of coating devices in paper producing systems, the decisions that have had to be made at the outset have proven disadvantageous since the continuous adaptation to satisfy the product requirements of various customers for coated papers cannot be made with single-purpose dosaging system.

The coating plants now used can have operating widths of up to 6000 mm. The speeds of operation and the application weights of the coating materials depend greatly upon the types and the desired properties of the paper to be coated and of the coated paper to be produced. For LWC paper (LWC stands for "lightweight coated"), for instance, the speeds are to up to 1200 m./min. with coating material application weights of up to 10 g./m.$^2$ side. For cardboard, for instance, the speeds are up to 600 m./min., with application weights of about 25 g./m.$^2$.

There has thus been an urgent need in coating plants for dosaging devices for the coating of webs, with which both lower and higher weights of application of coating material can be obtained without reequipping the plant and where both low and high speeds of operation can be used, all without sacrificing the quality of the properties of the coated surface.

SUMMARY OF THE INVENTION

The object of the present invention is to provide an apparatus for adjusting the weights of application of coating material upon the coating of webs and to also provide a process in which paper webs are coated with ordinary pigment dispersions, wherein by different techniques of operation, both low and high wet application weights of coating material are obtained, and with very good quality of the resulting coated surface.

According to the present invention, a process for the coating of traveling webs of paper, cardboard, or the like with ordinary pigment dispersions is provided. The invention is of course also suitable for the dosaging of pigment-free coating compositions.

First, excess coating material is applied to the web. The excess material is removed with a scraper. Alternatively, the scraper may simultaneously serve as an application device for all of the coating material, as well as the means that removes the excess. The scraper is swivelable about a swivel axis. The wet application weight of coating material is adjusted by the scraper in that the sharp-edged end of the entrance flank or entrance surface of the scraper presses against the surface of the coating at a point that usually lies in the plane formed by the center axis of the supporting roll and the swivel axis of the scraper.

By increasing the application pressure exerted by the scraper toward the web, the oppositely directed hydrodynamic pressure of the coating material is overcome and the elastic surface of the supporting roll is pushed inwardly in the pressing zone.

The pressing zone may be lengthened, by swiveling the scraper around its swivel axis, such that the sharp-edged end of the entrance flank of the scraper is moved 0.5 to 5.0 mm. from the plane formed by the central axis of the supporting roll for the web and the swivel axis of the scraper toward the side facing away from the entrance gap, i.e. downstream of the travel direction of the web. Alternately, instead of lengthening the pressing zone, the angle of the entrance gap between the support roller and the entrance flank of the scraper is increased by swinging the scraper around its axis. This effectively shortens the pressing zone. In the latter case, the sharp-edged end of the entrance flank of the scraper is removed 0.5 to 100 mm from the plane formed by the central axis of the supporting roll and the swivel axis of the scraper toward the side facing the entrance gap, i.e. upstream of the travel direction of the web.

Another object of the invention is to provide an apparatus for carrying out the foregoing process, and particularly for adjusting the wet application weight of the coating materials on a traveling web. A supporting roll supports the traveling web on the uncoated side of the web. The supporting roll has an elastic deformable surface, in known manner. A scraper, which is adjustable in its position in the direction toward the support roll, can be pressed with predetermined pressure against the coated side of the web of material. The scraper can also be swiveled around a swivel axis which extends parallel to the central axis of the supporting roll. The scraper is a rigid structure. The scraper is at rest in known manner during the coating process. The entrance side of the scraper, facing upstream of the travel direction of the web, has a curved entrance flank with a radius of curvature preferably in the range of 50 to 200 m. The entrance flank terminates at its downstream end at a sharp edge, which rests against the web of material and forms a pressing zone.

Other objects and features of the invention are explained below with reference to the accompanying drawings.

DESCRIPTION OF THE PREFERRED EMBODIMENTS

Figure 1:
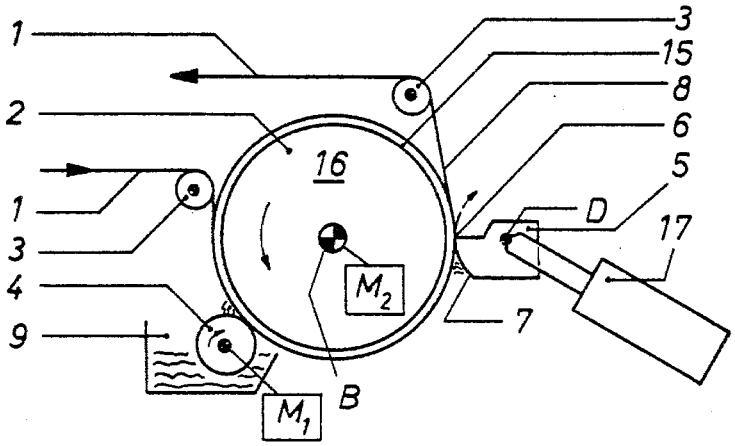
FIG. 1 is a diagrammatic cross-sectional view of one embodiment of a dosaging device for a web coating plant, according to the invention.

Referring to FIG. 1, a web 1 of material to be coated, for instance, paper or cardboard, is conducted around a guide roller 3 to the large support roller 2. The roller 2 comprises an annular peripheral covering 15 of an elastic, deformable material and a rigid core 16. The support roller 2 rotates about a fixedly supported axis B. The web is wrapped partially around the periphery of the roller 2 and is then moved off the roller 2 again over another guide roller 3. The web then passes into subsequent parts of the coating installation, for instance, a drier (not shown).

By means of an ordinary, known applicator mechanism 4, such as a roller which carries coating material out of a reservoir, excess coating composition is applied to the web 1. The excess coating composition is then removed from the web 1 in the pressing zone formed by the support roller 2 and the scraper 5 and the composition that has been removed passed into a collecting trough (not shown). The properly adjusted thickness of coating 8 remains on the web 1 downstream of the scraper 5.

The scraper 5 may be swiveled about a fixedly supported support axis D. The axes B and D are parallel. The scraper 5 is supported bilaterally, i.e., at both of its axial ends by supports 17, in known manner in this art.

The scraper 5 has a curved entrance flank 7, whose curved surface is curved with a uniform radius and is generally opposed to the web and the roller 2.

The center-to-center distance of the parallel axes, the center axis B of the support roller 2 and the swivel axis D of the scraper 5, can be adjusted very accurately. In the arrangement of the supporting roller and the scraper shown in FIG. 1, their axes B and D lie in a horizontal plane. However, this horizontal orientation of the plane of the axes is not necessary. In alternate arrangements, the plane defined by these axes may be inclined from the horizontal to a greater or lesser extent. Either the support roller or the scraper may constitute the part of the installation, which is the higher one. The angle of inclination of the plane can be up to 90°. For structural reasons, however, angles of up to 45° are preferred.

The support roller 2, the scraper 5 and the applicator mechanism 4 (which have been shown only diagrammatically by way of example) are arranged in a strong bed (not shown). The axes B and D are stationary in the bed. The bed contains the required drive means $M_1$ for the applicator mechanism 4 and $M_2$ for the support roller 2. Via the adjustable bilateral, separated mounts 17 of the scraper 5 in the bed, the distance between the axes B and D can be adjusted. By reducing this axial distance, the scraper 5 exerts pressure in the direction towards the central axis B of the support roller 2. This forms a pressing zone between the elastic surface of the support roller 2 and the scraper 5. The coated web passes through this pressing zone, and the thickness of application of the coating material is adjusted in the pressing zone.

The scraper 5 is swivelable about its axis D so that either the sharp-edged downstream end of the entrance flank 6 or any desired points around the curved entrance flank 7 of the scraper 5 can be brought into contact with the surface of the coated web in order to select the desired length for the pressing zone. As the curved flank 7 has a single radius, the swiveling of the scraper maintains the spacing between the flank 7 and the roller, but changes the length of the pressing zone. Means necessary for the accurate reproducible adjustment of the scraper 5 are arranged in or on the bed (not shown). Once the desired swivel orientation of the scraper has been selected, the desired pressing pressure thereof against the supporting roll 2 is produced mechanically, hydraulically or pneumatically via the supports 17 at the two ends of the scraper 5 by means known per se.

In practice, pneumatic systems have proven better than mechanical or hydraulic ones and are therefore preferred for use in the apparatus of the invention.

Figure 2:
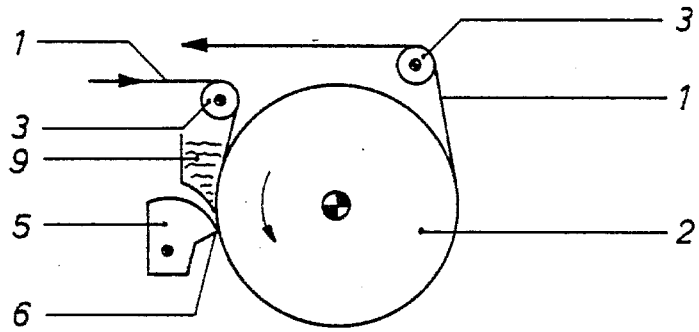
FIG. 2 is the same type of view of another arrangement of dosaging device for use with a web coating plant, according to the invention.

In the embodiment of FIG. 2, the web of material is also conducted around a guide roller 3 to the support roller 2, is wrapped partially around the roller 2 and is then removed from the roller 2 by a second support roller 3. Instead of there being a separate applicator mechanism, in this case the scraper 5, in combination with the trough 9 and the web of material 1, forms an applicator station which also regulates the thickness of the applied coating material by means of the scraper 5. After the web has passed through the pressing zone between the scraper 5 and the support roller 2, only the adjusted thickness of applied coating material is present on the web.

Figure 3:
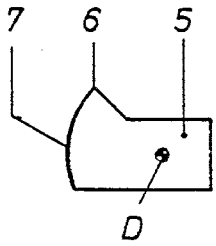
FIG. 3 diagrammatically shows a scraper like that in FIGS. 1 and 2 for use with a web coating device according to the invention.

With reference to FIG. 3, the shape of the scraper may be selected as desired. Its cross-section illustrated in FIG. 3, must be such that even with transverse operating widths of the rollers and scrapers of 3000 to 5000 mm., the scraper will be rigid in itself. The scraper 5 in FIG. 3 is in the form of a sector of a roll, having the axis of rotation D. The scraper 5 has the curved entrance flank 7 and the sharp edged end 6. The radius of curvature of the entrance flank 7 can be in the range of 30–500 mm. Radii of 50–200 mm. are preferred. Radii of 75–130 mm. have proven particularly suitable.

In one further embodiment of the scraper 5 (not shown), the sharp-edged end 6 of the entrance flank 7 is formed of a replaceable carbide rail. One side of the rail is ground to correspond to the radius of curvature of the entrance flank in order to avoid discontinuities in the entrance flank. Rails of a thickness of 10 mm. of alloy steel have proven suitable, but other corrosion-resistant materials can also be used, provided that they are sufficiently hard and resistant to abrasion. For instance, suitable plastics might be used.

Figure 4:
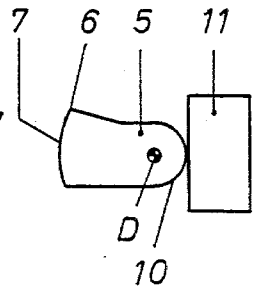
FIG. 4 shows a second embodiment of a scraper.

The scraper embodiment of FIG. 4 has the advantage, in the case of larger transverse operating widths, of still further improving the stability of the rigid scraper. The scraper 5 in this embodiment of the invention is provided on its side facing away from the entrance flank 7 with a cylindrically curved supporting surface 10 having a central axis which is concentric with the swivel axis D. Against this supporting surface 10, there is frictionally pressed a supporting body 11 which includes a bearing line or a bearing surface for the support surface 10. The support body 11 is fastened at its ends (not shown) in the bed (not shown) and is adjustable in such a manner that it improves the stability of the inherently rigid scraper 5 and makes it possible for the scraper to maintain an absolutely uniform pressure over the entire working width even in the case of very wide installations.

Figure 5:
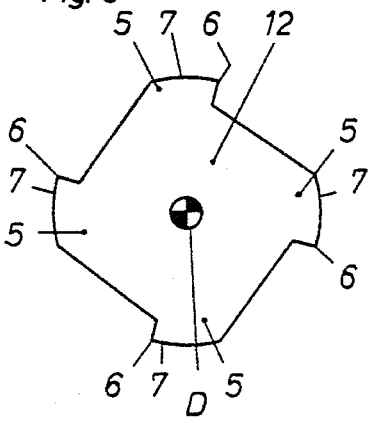
FIG. 5 shows a third embodiment in which a plurality of scrapers are arranged on a cylindrical roll body or in which several scrapers, each developed as a roll sector, are combined structurally to form a single unit.

In the scraper embodiment of FIG. 5, a plurality of scrapers 5 are combined into a single unit. The individual scrapers 5 can have either identical or differently curved respective entrance flanks 7. In the differently curved scraper flanks 7, the radii of curvature can be different. In fact, over a particular flank 7, the radius may vary over a continuum so that at different points along the flank, there are different radii. The plurality of scrapers 5 are arranged on a cylindrical body 12, for instance, a roll body. These scrapers are preferably distributed uniformly around the surface of the roll body. Symmetrical arrangements are preferred but not necessary. The radius of the roll body is preferably so large that it is identical with the largest desired radius of curvature of the entrance flanks 7. In this way, a part of the surface of the roll body forms the entrance flank 7 of one or more of the scrapers 5. The sharp-edged ends 6 of the entrance flanks 7 of all scrapers 5 arranged on the roll body 12 are at the same distance from the axis of rotation D of the roll body. Desired smaller radii of curvature of some of the scrapers 5 are produced by corresponding working of the entrance flanks 7, without its being necessary to change the distances between the edges 6 and the center of the roll. By swinging the roll body 12 around the axis of rotation D, the sharp-edged end 6 of a selected scraper 5 can be brought into the operating position with respect to the supporting roll 2 (not shown in FIG. 5). This embodiment makes it possible, without major interruptions in operation of the apparatus, to replace a scraper 5 by simply swinging the roll body 12 around its axis of rotation D. Such scraper replacement can be necessary, for instance, when the sharp-edged end 6 of one curved entrance flank 7 is defective or dirty. However, a changed radius of curvature of the entrance flank 7 of the scraper may also be necessary upon a change in product, in order to vary the weight of application of coating material. With the structure just described of a roll body having a plurality of scrapers 5, no refitting is necessary. It is merely necessary to rotate the roll body in order to bring the required scraper 5 into the operating position.

The radii of curvature used in the embodiment of FIG. 5 for the entrance flanks 7 are the same as when the scrapers 5 are roll sectors (e.g. FIG. 3), and these radii are between 30 and 500 mm. The radius of the support roller 2 which is not shown in FIG. 5, but is shown in FIGS. 1 and 2, is 150 to 500 mm, depending on the operating width of the apparatus, with larger operating widths usually requiring larger radii in order to avoid sagging.

The support roller 2 has an annular elastic covering 15 around a hard core 16. Synthetic rubbers or synthetic polymers having the necessary elasticity are suitable for the covering. The surface hardness of the support roller 2 can be determined by different methods of measurement. There are customary Pusey and Jones plastometers (P+J units, measured with a ⅛" ball) or Shore hardness measuring instruments (Shore A, measured with truncated cone). The surface hardness of the support roller should be between 74 and 34 Shore A units (=60-197 P+J). 56-41 Shore A (=108-160 P+J) are preferred. 50-44 Shore A (=127-149 P+J) are particularly preferred. The preferred embodiments of the method of the invention, in which the scraper 5 is swiveled around its axis of rotation D, make it possible to adjust the applied weight of the coating material within a particularly wide range.

For providing a high weight of application of coating material, the flattest possible introduction gap and a lengthening of the pressing zone between the scraper and the support roller are necessary. In order to achieve this, the end edge of the introduction flank of the scraper is moved or swiveled downstream, toward the side of the scraper facing away from the entrance gap and out of the plane formed by the central axis B of the support roll and the swivel axis D of the scraper. Only a slight spacing of up to about 5 mm. out of the plane is possible without impairing the quality of the surface of the coating. In the case of greater swiveling of the scraper in the same direction, the undesired recontacting, that occurs with roller dosing, of the surface of the scraper with the moist surface of the coating may occur, and this is to be avoided in accordance with the invention. The peeling phenomena which are thereby caused produce grooves in the surface of the coating and a cloudy transparency of the coating is brought about. With the method of the invention, for a predetermined radius of curvature of the introduction flank 7 of the scraper 5, the highest wet application weights are obtained. The application weight of coating material is, however, also dependent upon the pressure applied by the scraper, the properties of the web material to be coated, the properties of the coating composition and the speed of the machine.

For the lowest possible application weight, a steep introduction gap and a short pressing zone are necessary. In order to obtain this, the scraper is swiveled around its swivel axis so that the sharp-edged end of the introduction flank is moved upstream in the travel direction of the web, out of the plane defined by the axes of the support roller and the scraper toward the side of that plane facing the introduction gap. The distance of the sharp-edged end from the plane is in the range of 0.5 to 100 mm. In the normal case, however, for a given radius of curvature of the entrance flank and constant pressing by of the scraper on the coating layer, a distance of about 55 mm. is sufficient in order to reduce the application weight of 30 g./m.$^2$/side to 7 g./m.$^2$ and less. The surface hardness of the support roll also plays a part in this. In the case of hard roll surfaces with correspondingly low depths of indentation of the scraper, a shorter pressing zone is produced so that the distance of the sharp-edged end from the above-described plane, which is necessary for a given reduction in weight, is less than with softer support-roll surfaces. In addition to the application pressure, the main effect is obtained by increasing the introduction angle of the dosaging gap. The larger the angle, i.e. the steeper is the angle of attack of the scraper, the less the weight of coating material that is applied, the other parameters remaining the same. In addition to the process parameters, the angle of attack of the scraper can also be affected by suitable selection of the radius of curvature of the introduction flank of the scraper and also by an arrangement of the support roll and the scraper, wherein their axes lie in an inclined plane. These possibilities of variation are, however, foreclosed upon the construction of the coating plant, and the above stated parameters can thereafter no longer be varied as desired. The embodiment of scraper of FIG. 5, in which a plurality of scrapers are arranged on a cylindrical body, proves particularly advantageous therefore, since various different radii of curvature are available without extensive retooling.

The method of the invention will be described in further detail on the basis of the following example:

A so-called coating base paper having a basis weight of 75 g./m.$^2$ is to be coated (A) with 7 g./m.$^2$ and (B) with 25 g./m.$^2$ of a coating compound of the following composition:

100 parts of pigment (clay, chalk, satin white);
10 parts of vehicle, for instance carboxylated styrene-butadiene latex with 50% solids;
4 parts of soluble vehicle, for instance casein;
1 part of caustic alkali, for instance 25% NaOH;
74 parts of water.

The coating composition also contains the required amounts of dispersion aids, antifoaming agents and other customary additives.

The coating plant has the arrangement shown in FIG. 1. The width of the web is 315 cm. A scraper of the type shown in FIG. 5 is used, wherein four scrapers of the same radius of curvature (150 mm.) are arranged on a roll body. The support roll has a diameter of 800 mm. Its surface hardness is 46 Shore A (140 P+J units).

With a web speed of 500 m./min., excess coating material is applied to the web 1 by an ordinary immersion roll applicator 4 and is then removed by the scraper 5. For this purpose, the sharp-edged end 6 of the scraper 5 is pressed against the coated surface of the web so strongly that the built-up hydrodynamic pressure of the coating material is overcome and a pressing zone is formed resulting in the pressing inward of the elastic surface of the support roller 2. Due to the elastic deformation of the support roller, a gap is produced during operation between the surface of the support roller and the edge of the scraper. The coated web then passes through the gap. The thickness of application of the coating material can be adjusted to a specifically defined amount. Depending on the length of the pressing zone and the pressure applied, only the desired thickness layer of the coating material remains on the web. In this connection, a higher pressure and/or a shorter pressing zone results in a decrease in the thickness of the coating material. Conversely, a longer pressing zone and/or lower pressure leads to higher weights of application of coating material. A short pressing zone is obtained when the sharp-edged end of the scraper is pressed against the surface of the web at the point lying in the plane formed by the central axis of the support roll and the axis of rotation of the scraper. The sharp-edged end of the scraper is pressed so strongly that the surface of the support roll is depressed. Also, depending upon the radius of curvature of the entrance flank of the scraper, a shorter or a longer pressing zone is formed, with smaller radii shortening the pressing zone. For any given radius, the pressing zone can be shortened further by swiveling the scraper around its axis of rotation. The sharp-edged end of the entrance flank of the scraper is moved out of the plane formed by the central axis of the support roll and the swivel axis of the scraper upstream in the direction toward the inlet-gap side. In this way, the angle of the inlet gap between the support roller and the entrance flank of the scraper is increased. The increase has the same effect as reducing the radius of curvature of the entrance flank of the scraper.

To lengthen the pressing zone for a given radius of curvature of the entrance flank, the scraper is swiveled around its swivel axis, wherein the sharp-edged end of the entrance flank is moved out of the plane formed by the central axis of the support roll and axis of rotation of the scraper toward the side facing away from the entrance gap.

As a final parameter, the application pressure is within certain limits also to be controlled. The above-indicated possibilities of adjusting the weight of coating material show the great and surprising advantage of the method of the invention and the apparatus suitable for performing the method.

To apply the low application weight (A) of 7 g./m.$^2$ of coating material, known blade type scrapers have proven particularly suitable. This type of scraper develops its advantages with a steep angle of attack of the blade and high application pressure. A comparable effect is obtained with the invention by forming a short length pressing zone, wherein the end of the scraper flank is removed about 40 mm. out of the plane of the axes, B, D toward the side of the entrance gap. In the case of a pressure of 3 kg./cm., which is a linear pressure produced pneumatically on the lateral ends of the scraper in the bed against the support roll, there is obtained in the present case an application of wet material which, when dried, i.e. to 6% moisture, amounts to coating material at 7 g./m.$^2$.

The application weight was determined for the purposes of verification in each case at the same length position along the web at the outer edges and in the middle of the web. Average values from several measurements showed web outer edges: 7.0 g./m.$^2$ and 7.1 g./m.$^2$, web center: 7.0 g./m.$^2$. The maximum deviations between the individual measurements were 0.5 g. This evaluation shows the good constancy in application weight transversely to the web that is realized by the invention.

To apply the higher application weight (B) of 25 g./m.$^2$ of coating material, a blade is less suitable due to the necessity for a small angle of scraper attack and for low application pressure. Ordinarily, other application devices besides blades are required for higher application weights, for instance, a roller application mechanism. According to the invention, the same dosaging device can be used for applying a higher application weight as was used for applying a lower application weight of coating material. It is now possible by lengthening the pressing zone also to obtain a higher coating weight without unacceptable variations in application weight transversely to the web. To satisfy high quality demands, the range of weight deviations of the application weights which can be tolerated is limited. The operating widths of the coating plants have been continuously increased. Unfortunately, deviations in the application weight transverse to the web produced by traditional dosaging devices necessarily had to be tolerated. This disadvantage is overcome by the present invention.

In order to lengthen the pressing zone, the sharp-edged end of the introduction flank of the scraper is moved or swiveled about 0.5 mm. from the plane of the axes B, D downstream in the travel direction of the web toward the side facing away from the entrance gap. The resulting scraper action is comparable to that of a roll application mechanism. With a linear application pressure of 3 kg./cm.$^2$ produced at the lateral ends of the scraper in the bed, against the support roll, a wet application is obtained, which when it is dry (6% moisture), amounts to a weight of coating material of 25 g./m.$^2$.

The application weight is determined for purposes of verification in each case at the same distance along the web, at the outer edges and in the center of the web. Average values from several measurements showed the following thicknesses: web outer edges: 25 g./m.$^2$ and 24 g./m.$^2$, web center: 24 g./m.$^2$. The maximum deviations between the individual measurements amounted to 2 g. This evaluation shows the constancy of coating weight transverse to the web.

One essential advantage of the method of the invention is that, regardless of the coating material application weight desired, a pressure can always be selected which permits the gap transverse to the web to be accurately developed, even with large web and roller widths. One requirement for this is proper elasticity of the surface of the support roll. The support roll must permit such strong pressing of the scraper that by deformation of the surface of the support roll, a stable pressing zone which is precisely equal transversely across the entire web is formed. Also, the scraper must be inherently rigid. With regard to the structural expense for producing the scraper, the supporting roll and the mounts thereof in the bed, the scraper pressure should be as low as possible so that mounts will not be too costly. However, the pressure must be sufficiently great that at least the hydrodymaic pressure of the coating material, which is built up with web speeds of up to 1200 m./min. customary today, is compensated for. Another advantage of the method of the invention is that with only a single device, very different coating material application weights are possible with lesser variations than heretofore customary, particularly in the case of large operating widths. In this connection, there are obtained qualities in surface and transparency of the coating which were obtainable heretofore only with separate, different dosaging devices especially adapted to high or low application weights.

The advantages of the inherently rigid scraper of the invention are that it can be produced with the required precision without greater difficulty, and that it is also adjustable with great accuracy and reproducibility transverse to the web. The dosage gap between the support roll and the scraper is of contant thickness transversely across the web, and this makes possible smaller deviations from the desired coating material weight than was possible with the previously known dosaging devices.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A process for coating a traveling web of paper, or the like, with a coating material, comprising:

passing the traveling web over the circumferential, peripheral surface of a roll-shaped support; the support having an axis of rotation; the surface of the support being elastic where the traveling web passes over it; applying excess coating material to the outward surface of the traveling web which is passing over the support;

scraping off excess coating material from the surface of the traveling web using a scraper having a curved entrance flank that faces toward the outward surface of the traveling web, wherein the entrance flank has a sharp edged end downstream in the motion of the web past the scraper; the scraper being movable with respect to the support for moving the position of the sharp edged end thereof with respect to the support;

pressing the sharp edged end of the entrance flank against the surface of the coating material traveling by with sufficient force that the support is pressed inward by the scraper;

the axis of the support roll and the swivel axis of the scraper generally define a plane between them, and before adjustment, the sharp edged end of the entrance flank is normally pressed against the surface of the coating material at the line across the web in the said plane, for selecting the application weight of coating material on the outward surface of the web, adjusting the length of the pressing zone at which the entrance flank presses upon the coating material by swiveling the scraper with respect to the support about a respective axis for shifting the position of the sharp edged end of the entrance flank with respect to the support so that the sharp edged end of the entrance flank is moved out of the said plane, and thereby adjusting the amount of the entrance flank that will be contacted by the coating material within the pressing zone.

2. The process for coating a traveling web of claim 1, further comprising increasing the application pressure of the scraper to counter and overcome the outwardly directed hydrodynamic force of the traveling coating material on the outward surface of the web.

3. The process for coating a traveling web of claim 1, wherein for lengthening the pressing zone, the scraper is swiveled so that the sharp edged end of the entrance flank is moved out of the said plane in the direction toward the side of the plane facing away from the entrance gap, which is downstream of the direction of travel of the traveling web.

4. The process for coating a traveling web of claim 3, wherein the scraper is swiveled so that the sharp edged end thereof is removed from the plane a distance in the range of 0.5–5.0 mm.

5. The process for coating a traveling web of claim 1, wherein for shortening the pressing zone and for simultaneously increasing the angle of the introduction gap between the entrance flank and the support roll, the scraper is swiveled around its axis for removing the sharp edged end of the entrance flank out of said plane in the direction toward the side facing the introduction gap and upstream of the direction of travel of the traveling web.

6. The process for coating a traveling web of claim 5, wherein the sharp edged end of the entrance flank is removed from said plane a distance in the range of 0.5–100 mm.

7. Apparatus for regulating the applied weight of coating material to be applied to a surface of a traveling web, comprising:

a support comprising a roll with a peripheral surface for supporting the traveling web at one surface of the web as the web travels and the traveling web passes over said peripheral surface of said roll; said support roll, where the web travels over it, having an elastic surface;

a rigid scraper having an axis about which said scraper may be swiveled; said scraper being adjustably positionable with respect to said support for causing said scraper to be pressed with predetermined pressure against the outward side of the web which is supported on the said support; means for setting the pressure applied by said scraper against the coating material on the web;

said scraper having an entrance flank which is opposed to said support roll peripheral surface and is curved around said scraper axis; said entrance flank having a terminal end with a sharp edge at the downstream end of the entrance flank in the direction of travel of the web, and said sharp edged end normally resets against the coating material on the surface of the web on said support; said sharp edged end defining a pressing zone with said support for the coating material on the traveling web;

said scraper being swivelable in position around its said axis with respect to said support so as to shift the position of said sharp edged end thereof with respect to said support, thereby repositioning said entrance flank so as to adjust the length of the pressing zone defined between said entrance flank and said support, thereby to regulate the applied weight of coating material on the traveling web as the traveling web travels past said entrance flank.

8. The apparatus of claim 7, wherein said support has an axis; said scraper axis being generally parallel to said support axis.

9. The apparatus of claim 7, wherein the radius of curvature of said entrance flank is in the range of 50–200 mm.

10. The apparatus ofclaim 8, wherein said support axis and said scraper axis are parallel, so as to define a plane; said scraper entrance flank free end edge is normally in said plane; said swiveling of said scraper with respect to said support moves said free end edge out of said plane for adjusting the length of the pressing zone between said entrance flank and said support.

11. The apparatus of claim 7 wherein said scraper is developed as a sector of a roll.

12. The apparatus of claim 7, wherein said support surface has a hardness of 74-34 Shore A units.

13. The apparatus of claim 7, wherein said support surface has a hardness of 56-41 Shore A units.

14. The apparatus of claim 7, wherein said support surface has a hardness of 50-44 Shore A units.

15. The apparatus of claim 7, wherein said sharp edged end of said entrance flank is formed of a hardened metal rail.

16. The apparatus of claim 15, wherein said rail is formed of a carbide.

17. The apparatus of either of claims 7 or 9 wherein said support roll has a radius in the range of 150 mm.–500 mm.

18. The apparatus of claim 17, wherein said scraper has a second side facing away from said entrance flank thereof; said second side being cylindrically curved around said scraper axis;

a support resting against said scraper second side for engaging it and thereby restraining swiveling of said scraper around said scraper axis.

19. The apparatus of claim 10, wherein said scraper has a second side facing away from said entrance flank thereof; said second side being cylindrically curved around said scraper axis;

a support resting against said scraper second side for engaging it and thereby restraining swiveling of said scraper around said scraper axis.

20. The apparatus of claim 9 wherein the radius of curvature of said entrance flank is in the range of 75–130 mm.

21. The apparatus of claim 7, wherein there are a plurality of at least two of said scrapers, each supported on said scraper axis and each swivelable separately into position with respect to said support for defining said pressing zone.

22. The apparatus of claim 21, further comprising a single roller body supported on said scraper axis and on which said plurality of scrapers are defined.

23. The apparatus of claim 22, wherein said two scrapers are normally at diametrically opposite positions.

24. The apparatus of either of claims 21 or 23, wherein said two scrapers are identical.

25. The apparatus of claim 22, wherein there are a plurality of pairs of said scrapers around said roller body, with the scrapers of each said pair being at diametrically opposite positions around said roller body.

26. The apparatus of claim 25, wherein both said scrapers of each said pair thereof are identical.

* * * * *